United States Patent [19]

Altherr

[11] Patent Number: 4,977,835

[45] Date of Patent: Dec. 18, 1990

[54] BODY BOLSTER CENTER PLATE ASSEMBLY

[75] Inventor: Russell G. Altherr, Munster, Ind.

[73] Assignee: Amsted Industries Incorporated, Chicago, Ill.

[21] Appl. No.: 432,220

[22] Filed: Nov. 6, 1989

[51] Int. Cl.[5] ..... B61B 12/00

[52] U.S. Cl. ..... 105/199.4

[58] Field of Search ..... 105/199.1, 199.4, 200

[56] References Cited

U.S. PATENT DOCUMENTS

| | | | |
|---|---|---|---|
| 3,664,269 | 5/1972 | Fillion | 105/199.4 |
| 3,797,674 | 3/1974 | Reynolds | 105/199.4 |
| 3,859,928 | 1/1975 | Adler | 105/199.4 |
| 4,056,065 | 11/1977 | Fiegl et al. | 105/199.4 |
| 4,353,311 | 10/1982 | Juntzen | 105/199.4 |
| 4,744,308 | 5/1988 | Long et al. | 105/199.4 |

*Primary Examiner*—Robert P. Olszewski
*Assistant Examiner*—S. Joseph Morano
*Attorney, Agent, or Firm*—Edward J. Brosius; Charles E. Bouton

[57] ABSTRACT

A center plate for railway cars is provided that comprises outwardly projecting positioning lugs which are seated in corresponding-shaped notches located proximate the underedge of the center sill pocket. The center plate is entirely groove welded to the center sill pocket. The corresponding-shaped seating arrangement will only accept the positioning lugs when the center plate is in its proper orientation.

6 Claims, 3 Drawing Sheets

BODY BOLSTER CENTER PLATE ASSEMBLY

BACKGROUND OF THE INVENTION

The present invention relates to railway vehicles having a combined body bolster center filler and center plate, such as is shown in U.S. Pat. No. 3,664,269, and more particularly to an improved center plate.

The center plate assemblies currently in use today comprise a center plate portion which is welded to the underedge of the center sill pocket walls. A vertical spacer plate for withstanding the shear and vertical forces imposed thereat is rigidly secured and located longitudinally within the sill at each opposite end of the center plate. A separate tie plate horizontally spanning and secured to the sill pocket exterior of the center plate and connected to the underedge of each spacer plate provides stiffening reinforcement and distributes longitudinal center plate forces to the car sill. The center plate projects from the car center sill pocket at least a distance which is equal to: the corresponding truck center plate depth ("bowl depth"), the thickness of the positioning lugs which rest on the exposed surface edges of the sill and spacer plates, and the height of the transition radius between the positioning lug and the vertical wall of the center plate. Specially applied lugs have been necessary to ensure that the center plate is properly oriented.

The Federal Railroad Administration and the American Association of Railroads (AAR) require that all railway cars must be able to couple with each other. Accordingly, for a standard coupler, which extends from the car center sill, a height range of 31 inches to 34 inches has been set for American railway cars. Car builders have found it difficult to meet this upper standard, especially when their railway vehicles are initially offered due to high-end tolerances of various components such as the stiffness of new springs prior to settling, wheels only being furnished as oversized (with plus tolerances), etc.

Furthermore, lower coupler heights are desirable since this also results in a lower center of gravity in the railway vehicle which makes the vehicle less apt to tip. Hence, any modifications made to the center plate which result in coupler height reduction are very important to the car building industry.

Summary of the Present Invention

Accordingly, an object of the present invention is to provide a center plate which has a reduced distance of projection from the underedge of the center sill pocket permitting a lower coupler height.

A further object of the proposed invention is to provide a center plate which may receive a groove-type weld about its entire periphery, including the positioning lugs, for attachment to the opposed underedge surfaces of the center sill pocket for more efficient weld attachment than the currently used fillet-type weld about the positioning lugs.

Another object of the proposed invention is to provide a center plate with a rejection feature which prohibits attachment to the center sill pocket when the center plate is not in proper orientation.

By the present invention, it is proposed to overcome the difficulties encountered heretofore. To this end, it has been discovered that notches may be cut in the tie plates thus forming positioning seats in which outwardly projecting, corresponding shaped positioning lugs on the center plate may be placed in a recessed fashion respecting the center sill pocket thus reducing the projection distance of the center plate from the underedge of the center sill pocket.

At least one of the center plate and the underedge of the center sill pocket contains a chamfer- or groove-shaped relief at nearly all points of connection thus providing for groove-type weld attachment therebetween. The corresponding shaped seating arrangement will only accept the positioning lugs when the center plate has been placed in its proper orientation in which contours in the center plate bearing surface assist in the distribution of force on the truck bolster during rail car rocking action.

Description of the Preferred Embodiment

Figure 1:
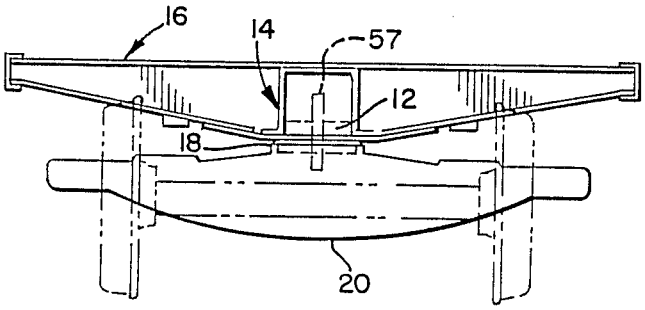
FIG. 1 is an elevation of a bolster construction containing the invention hereof shown assembled on a supporting truck bolster.

An improved body bolster center plate 12 is assembled in a railway vehicle body center sill 14 where center sill 14 is transversely intersected by body bolster 16 and center plate 12 is connected via an interfit with bowl 18 to a truck bolster 20 as shown in FIG. 1. Such a connection is standard in the industry and will not be described in further detail. Any mention to "top", "bottom", "underside", "topside", "horizontal", "vertical", etc. herein will be with regard to the orientation shown in FIG. 1.

Figure 2:
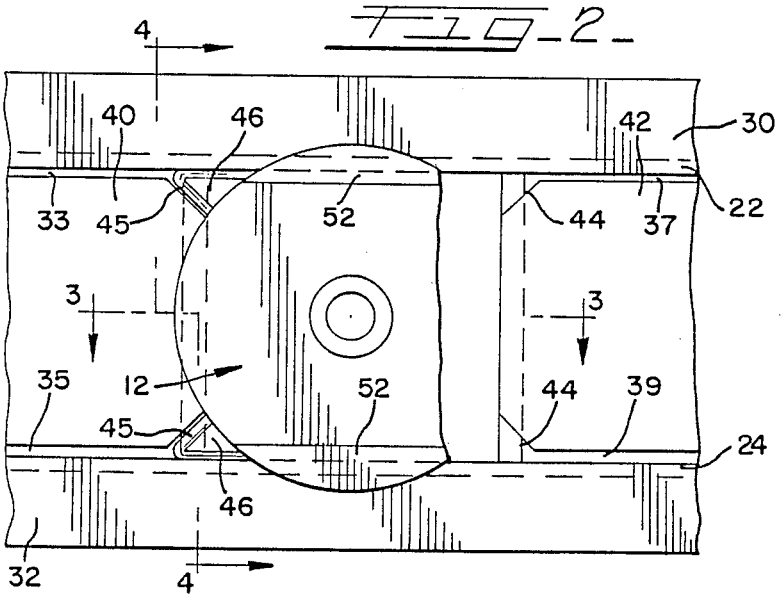
FIG. 2 is a partial underside plan view of one embodiment of a center plate mounted onto the center sill of the car body.
Figure 3:
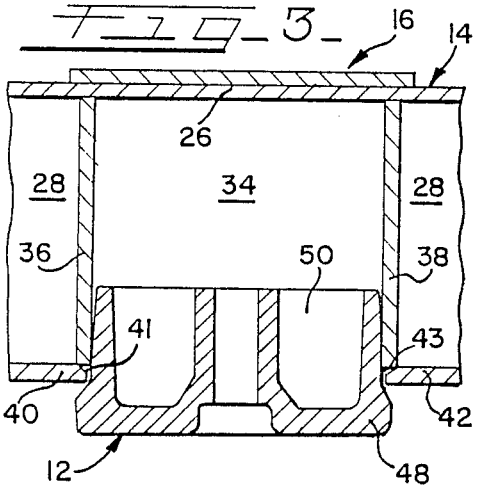
FIG. 3 is a sectional elevation taken substantially along the car center line 3—3 of FIG. 2.
Figure 4:
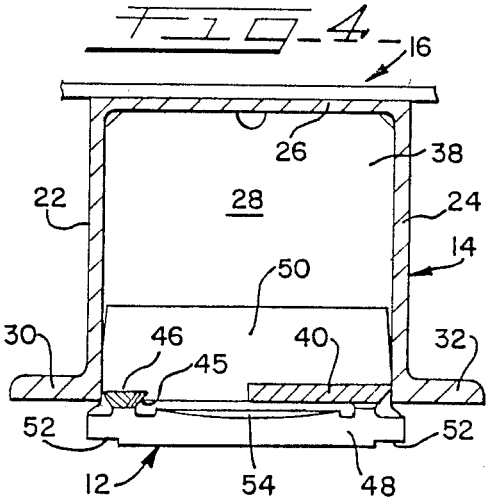
FIG. 4 is a sectional elevation taken in the bolster direction substantially along the line 4—4 of FIG. 2.

Referring now to FIGS. 2–4 there is shown a first combination embodiment of center plate 12 seated within the underside opening of center sill 14. As can be seen, center sill 14 is comprised internally in cross-section as an inverted U-shaped steelrolled section consisting of side walls 22 and 24 joined by top wall 26 to define a centrally interior longitudinally extending hollow channel 28 therein. At the underside of center sill 14 for increasing strength of the section are a pair of parallel longitudinally extending flanges 30 and 32 laterally integral with side walls 22 and 24, respectively. Center sill 14 may alternatively be constructed out of a pair of Z-shaped or channel-shaped sections.

To receive center plate 12 there is defined at the intersection of the sill 14 and bolster 16 and about the geometric center of bolster 16 a central pocket 34 formed open and exposed at the bottom by parallel spaced apart vertically arranged spacer plates 36 and 38 and the included portions of sill walls 22 and 24 therebetween. Each spacer plate is complementary to the internal sill cross-section thereat and is completely welded about its periphery in a rigid fixed relation to the surfaces of side walls 22 and 24 and the top wall 26 to resist distortion of center sill 14 as a result of any forces that act eccentric of the centroid of center sill 14 such as rock and roll movement of the car. By being so secured, spacer plates 36 and 38 act as a virtually perfect bolster shear transfer device while also serving as vertical load support. Spacer plates 36 and 38 terminate a distance short of the bottom edges of flanges 30 and 32. This is to accommodate the thickness of horizontal tie plates 40 and 42 which extend between and lie substantially in line with flanges 30 and 32 and laterally across channel 28 adjacently outward of pocket 34 while overlapping the bottom edges of spacer plates 36 and 38 respectively. Tie plates 40 and 42 may be chamfered at their point of overlap with spacer plates 36 and 38 for weld securement therebetween as shown at 41 and 43.

Tie plates 40 and 42 may also be chamfered as shown at 33, 35, 37 and 39 to be welded on all surfaces intersecting with sill walls 22 and 24 and flanges 30 and 32 to form completely rigid joints thereat. The corners of tie plates 40 and 42 are notched below the intersection of spacer plates 36 and 38 with side walls 22 and 24 to form positioning seats 44 for cooperation with positioning lugs 46 of center plate 12. Alternatively, these notches could be located in the spacer plates or the flanges (not shown).

Figure 5:
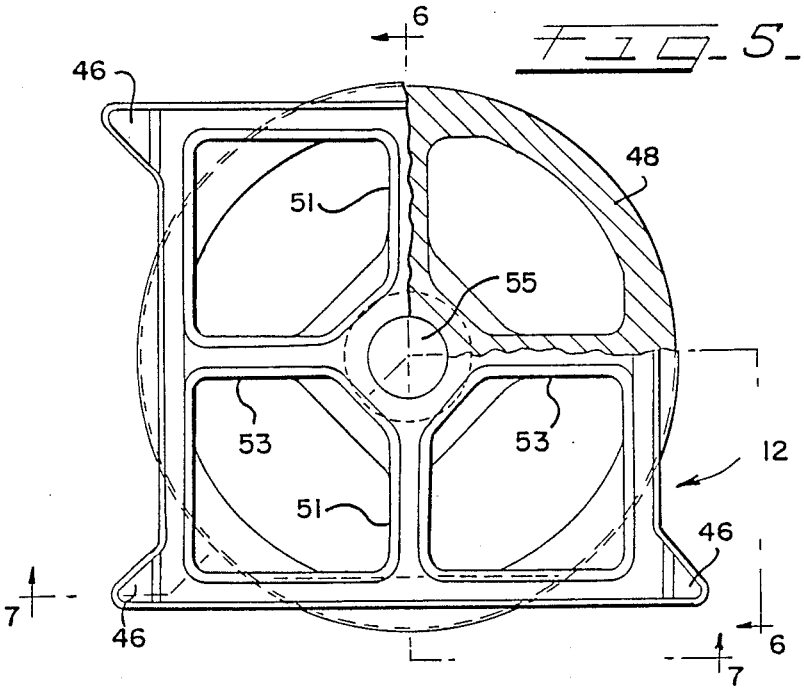
FIG. 5 is a topside plan view, partially in section of the center plate.
Figure 6:
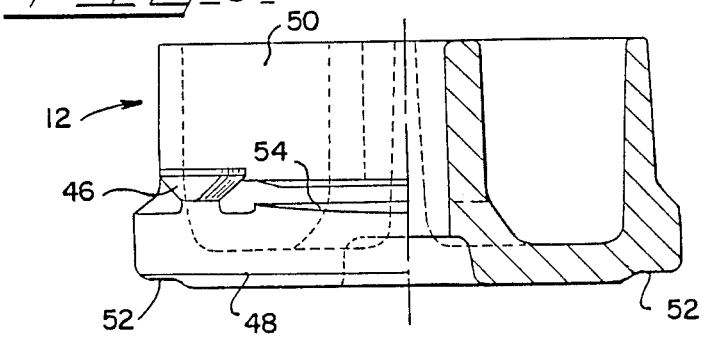
FIG. 6 is an elevation in partial section taken substantially along lines 6—6 of FIG. 5.
Figure 7:
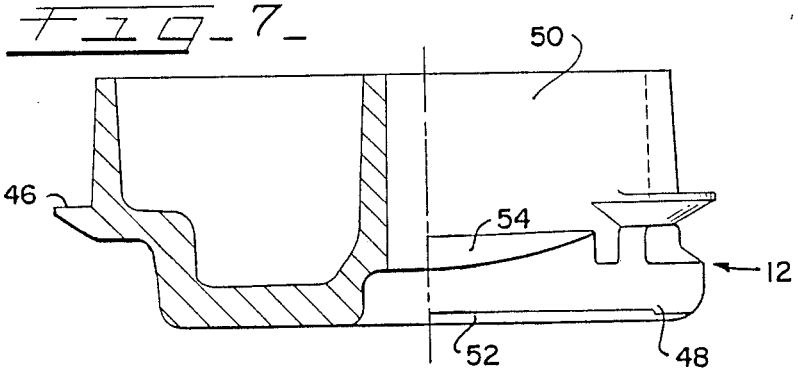
FIG. 7 is an elevation in partial section taken substantially along lines 7—7 of FIG. 5.

Center plate 12 hereof is most clearly shown in FIGS. 5–7. The center plate 12 may be cast or forged and comprises a lower circular cap section 48 to cooperate with truck bolster bowl 18 and preferably having a diameter greater than the internal clearance dimensions of pocket 34. Communicating integral with the cap is upper webbed reinforcing section 50 of dimension able to be received within pocket 34. The upper webbed reinforcing section 50 has internal webs 51 and 53 centrally intersecting to efficiently add strength to the center plate 12 and to form a socket 55 to receive a king pin 57 (seen in FIG. 1).

The point of integration between circular cap section 48 and webbed reinforcing section 50 is represented by four corner positioning lugs 46 each having a thickness approximately the same as that of its corresponding tie plate 40, 42 and each projecting outwardly from the rectangular-shaped portion of center plate 12 to cooperate with positioning seats 44. This corresponding-shaped seating arrangement acts to reduce the distance that center plate 12 projects from the underedge of pocket 34 of center sill 14 which in turn, reduces the overall sill and coupler height above the rails. It further serves to orient the center plate in its proper direction in which contours 52 in the center plate bearing surface (which must be oriented to extend longitudinally of a railcar) assist in the distribution of force on truck bolster 20 during rail car rocking action. The positioning seats 44 will not accept positioning lugs 46 in such a manner that contours 52 are misdirected.

The center plate 12 contains a relief in the shape of a chamfer or J-groove 45 about its periphery including positioning lugs 46 at all points of connection with the opposed underedge surfaces of pocket 34 of center sill 14. This chamfer or J-groove provides for a groove-type weld for more efficiently attaching center plate 12 to pocket 34 of center sill 14 than the fillet weld which is currently used about the positioning lugs 46 since it is more nearly in the plane of the centroid of the center plate 12 at the point of integration between circular cap section 48 and webbed reinforcing section 50. In addition, a groove weld is more efficient since there is full contact of the weld with the parent metal and the transfer of force is thus planar rather than eccentric. Alternatively, the opposed underedge surfaces of pocket 34 of center sill 14 may contain such a relief (not shown). Furthermore, both the periphery of center plate 12 and the opposed underedge surfaces of pocket 34 of center sill 14 may contain such reliefs (not shown). At points of connection between center filler plate 12 and pocket 34 of center sill 14 which are overlapped by circular cap section 48, the upper outer edges 54 of circular cap section 48 may be bevelled to allow for welding therein.

Assembly of center plate 12 into pocket 34 within the underedge of center sill 14 is by first placing positioning lugs 46 into positioning seats 44 and then groove welding between the periphery of center plate 12 and adjacent sill or tie plate edges thereat. When so secured, the welds act in forming a secured and completely boxed structure with center plate 12 closing off the pocket bottom.

Figure 8:
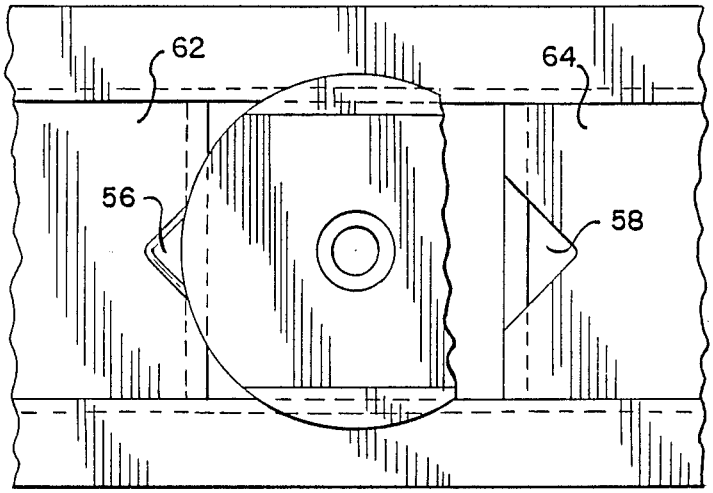
FIG. 8 is a partial underside plan view of a second embodiment of the center plate mounted onto the center sill of the car body.
Figure 9:
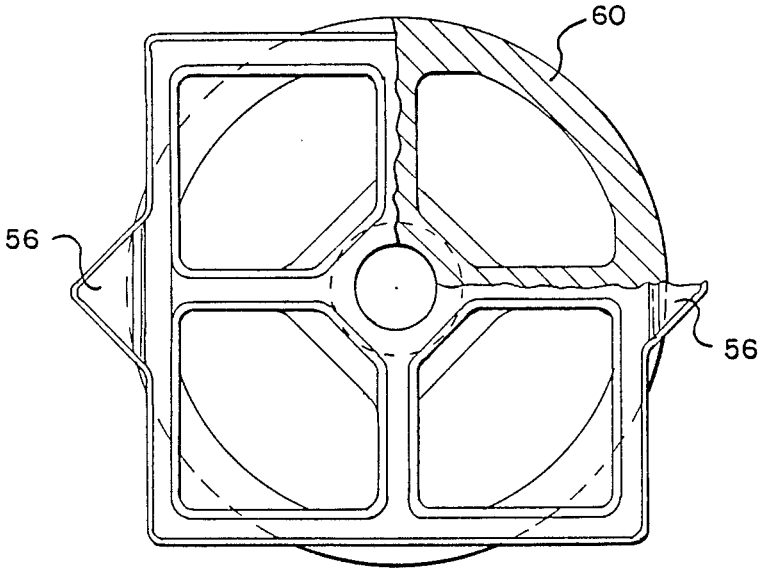
FIG. 9 is a topside plan view, partially in section of the second embodiment of the center plate.

Referring now to FIGS. 8-9, there is shown a second embodiment in accordance herewith in which an alternative positioning lug 56 and positioning seat 58 are used. In this particular embodiment, positioning lugs 56 are located at the point of integration between circular cap section 48 and webbed reinforcing section 50 on both sides lying laterally across channel 28 and corresponding to positioning seats 58 in tie plates 62 and 64. Various shapes and arrangement of positioning lugs and positioning seats are permissible.

The foregoing description and drawings explain and illustrate the best known mode of the invention and those skilled in the art who have the disclosure before them will be able to make modifications and variations therein without departing from the spirit and scope of the invention which is defined in the following claims.

What is claimed is:

1. A body bolster center plate assembly for seated attachment within notches located proximate the underedge of the central pocket of a center sill of a railway vehicle, said center plate assembly comprising a circular cap section to cooperate with a truck bolster bowl, an integrated webbed reinforcing section located proximate and opposite of said circular cap section for insertion into said pocket of said center sill, and positioning means including one or more integrated lugs located proximate said point of attachment with said pocket of said center sill, said positioning lugs corresponding to the shape and location of said notches for receipt therein, such that the surface of said positioning lugs are substantially flush with the surface of said underedge of said pocket of said center sill, thereby providing for recessed seating of the center plate within the underedge of said pocket of said center sill.

2. The invention according to claim 1 in which said positioning means comprise four outwardly projecting corner positioning lugs at the point of integration between said circular cap section and said web section for recessed seating within said notches.

3. The invention according to claim 1 in which said notches are cut in the tie plates located proximate the underedge of said pocket of said center sill.

4. The invention according to claim 1 in which said positioning means comprise positioning lugs at the point of integration between said circular cap section and said webbed reinforcing section on opposite sides of said center plate lying laterally across said center sill, said positioning lugs located outwardly adjacent said pocket of said center sill.

5. The invention of claim 1 in which at least one of said center plate and surfaces proximate to said underedge of said pocket of said center sill is grooved at all points of connection to provide for groove-type weld attachment therebetween.

6. The invention according to claim 1 in which said center plate includes parallel contours located on opposite sides of the surface of said circular cap section which interfaces with a corresponding surface on said truck bolster bowl, said center plate positioning lugs and said notches being correspondingly shaped to allow seating therebetween only when said contours are extending in a longitudinal direction along said center sill.

* * * * *